US007717294B2

(12) United States Patent
Bodemann

(10) Patent No.: US 7,717,294 B2
(45) Date of Patent: May 18, 2010

(54) BEVERAGE DISPENSING GAS CONSUMPTION DETECTION WITH ALARM AND BACKUP OPERATION

(75) Inventor: Timothy S. Bodemann, Raleigh, NC (US)

(73) Assignee: South-Tek Systems, Raleigh, NC (US)

( * ) Notice: Subject to any disclaimer, the term of this patent is extended or adjusted under 35 U.S.C. 154(b) by 1343 days.

(21) Appl. No.: 11/156,859

(22) Filed: Jun. 20, 2005

(65) Prior Publication Data

US 2006/0283877 A1 Dec. 21, 2006

(51) Int. Cl.
*B67D 1/00* (2006.01)

(52) U.S. Cl. ..... 222/53; 222/1; 222/4; 222/39; 222/61; 222/132; 222/135; 222/145.6; 222/399

(58) Field of Classification Search ..... 222/1, 222/4, 23, 39, 53, 59, 61, 396, 399, 129, 222/129.1, 129.2, 132, 129.4, 133, 134, 145.1, 222/135, 145.6

See application file for complete search history.

(56) References Cited

U.S. PATENT DOCUMENTS

| | | | |
|---|---|---|---|
| 1,068,122 | A | 7/1913 | Goehring |
| 2,210,083 | A | 8/1940 | Johnson |
| 2,633,959 | A | 4/1953 | Von Stoeser |
| 3,184,958 | A | 5/1965 | Eaton |
| 3,368,212 | A | 2/1968 | Klyce |
| 3,392,580 | A | 7/1968 | Bain et al. |
| 3,472,425 | A | 10/1969 | Booth et al. |
| 3,565,405 | A | 2/1971 | Black |
| 3,567,387 | A | 3/1971 | Jones |
| 3,611,981 | A | 10/1971 | Warncke |
| 3,785,333 | A | 1/1974 | Warncke et al. |
| 3,794,026 | A | 2/1974 | Jacobs |
| 3,841,344 | A | 10/1974 | Slack |
| 3,851,520 | A | 12/1974 | Schluter et al. |
| 3,937,194 | A | 2/1976 | Tamaki et al. |
| 3,943,261 | A | 3/1976 | Amon et al. |
| 3,952,740 | A | 4/1976 | Scurlock |
| 3,967,635 | A | 7/1976 | Sealfon et al. |
| 3,991,219 | A | 11/1976 | Kuckens |
| 4,007,456 | A | 2/1977 | Paige et al. |
| 4,023,587 | A | 5/1977 | Dobritz |
| 4,064,899 | A | 12/1977 | Lehmann |
| 4,100,537 | A | 7/1978 | Carlson |
| 4,116,612 | A | 9/1978 | Melgaard |

(Continued)

*Primary Examiner*—Frederick C. Nicolas
(74) *Attorney, Agent, or Firm*—Coats & Bennett, PLLC

(57) ABSTRACT

A mixed-gas beverage dispensing system for driving beverages from a container to a tap with a predetermined ratio of carbon dioxide ($CO_2$) and nitrogen ($N_2$) gas includes one or more monitors to detect excessive consumption of $N_2$. The system may include a $N_2$ generator, with a monitor monitoring the $N_2$ generator to detect excessive operation thereof. The system may include a $N_2$ reservoir, with a monitor monitoring the pressure in the $N_2$ reservoir. The system may include a volumetric gas flow meter interposed in one or more mixed-gas distribution lines to monitor the flow of mixed gas. Upon detecting consumption of $N_2$ gas in excess of a predetermined threshold, a monitor may trigger an audible, visual, or electronic alarm; may shut down operation of the system; and/or may switch to one or more backup gas tanks containing $CO_2$, $N_2$ or a predetermined blend thereof, for continued beverage dispensing operation.

36 Claims, 2 Drawing Sheets

U.S. PATENT DOCUMENTS 4,176,617 A 12/1979 Pilipski
4,191,952 A 3/1980 Schreiber et al.
4,203,099 A 5/1980 Edwards
4,276,999 A 7/1981 Reichenberger
4,304,736 A 12/1981 McMillin et al.
4,345,612 A 8/1982 Koni et al.
4,350,115 A 9/1982 Pasternack
4,364,413 A 12/1982 Bersin et al.
4,399,744 A 8/1983 Ogden
4,417,589 A 11/1983 Favaloro
4,442,856 A 4/1984 Betz
4,457,303 A 7/1984 Durkan
4,487,155 A 12/1984 Olesen
4,502,842 A 3/1985 Currier et al.
4,537,038 A 8/1985 Alsenz et al.
4,549,563 A 10/1985 Monnier
4,550,726 A 11/1985 McEwen
4,607,342 A 8/1986 Seiden et al.
4,623,876 A 11/1986 Shima et al.
4,635,468 A 1/1987 Hickam et al.
4,648,395 A 3/1987 Sato et al.
4,648,888 A 3/1987 Rowland
4,656,933 A 4/1987 Aschberger et al.
4,662,154 A 5/1987 Hayward
4,665,809 A 5/1987 Aschberger et al.
4,669,415 A 6/1987 Boord
4,676,095 A 6/1987 Eberle et al.
4,708,827 A 11/1987 McMillin
4,729,495 A 3/1988 Aschberger et al.
4,761,639 A 8/1988 Pyke et al.
4,782,334 A 11/1988 Meaney
4,783,990 A 11/1988 Eberle et al.
4,808,346 A 2/1989 Strenger
4,823,788 A 4/1989 Smith et al.
4,825,802 A 5/1989 Le Bec
4,839,014 A 6/1989 Park et al.
4,858,637 A 8/1989 Rempel et al.
4,866,594 A 9/1989 David et al.
4,866,633 A 9/1989 Nakane et al.
4,881,948 A 11/1989 Nakane et al.
4,916,437 A 4/1990 Gazzaz
4,928,728 A 5/1990 Nakane et al.
4,973,946 A 11/1990 Cowden, II
4,989,160 A 1/1991 Garrett et al.
4,990,057 A 2/1991 Rollins
4,990,893 A 2/1991 Kiluk
4,994,117 A 2/1991 Fehder
4,997,012 A 3/1991 Kizow
5,007,817 A 4/1991 Wallis
5,011,700 A 4/1991 Gustafson et al.
5,062,548 A 11/1991 Hedderick et al.
5,068,116 A 11/1991 Gibney et al.
5,074,299 A 12/1991 Dietz
5,102,627 A 4/1992 Plester
5,165,397 A 11/1992 Arp
5,188,257 A 2/1993 Plester
5,244,117 A 11/1993 Lombardo
5,265,465 A 11/1993 Thomas
5,270,069 A 12/1993 Plester
5,276,434 A 1/1994 Brooks et al.
5,293,771 A 3/1994 Ridenour
5,314,703 A 5/1994 Gibney et al.
5,316,181 A 5/1994 Burch
5,357,781 A 10/1994 Tikijian
5,419,358 A 5/1995 Sun
5,470,390 A 11/1995 Nishikawa et al.
5,537,914 A 7/1996 Gibney et al.
5,538,746 A 7/1996 Levy
5,546,073 A 8/1996 Duff et al.
5,552,171 A 9/1996 Gibney et al.
5,553,094 A 9/1996 Johnson et al.
5,553,749 A 9/1996 Oyler et al.
5,554,976 A 9/1996 Miyauchi et al.
5,621,213 A 4/1997 Barshad
5,639,224 A 6/1997 Schlossarczyk et al.
5,649,577 A 7/1997 Farkas
5,688,306 A 11/1997 Verini
5,694,118 A 12/1997 Park et al.
5,722,449 A 3/1998 Heinonen et al.
5,807,098 A 9/1998 Deng
5,855,646 A 1/1999 Verini
5,866,802 A 2/1999 Kimata et al.
5,887,611 A 3/1999 Lampotang et al.
5,890,490 A 4/1999 Aylsworth et al.
5,911,219 A 6/1999 Aylsworth et al.
5,973,326 A 10/1999 Parry et al.
5,988,859 A 11/1999 Kirk
6,067,022 A 5/2000 Laswick et al.
6,068,447 A 5/2000 Foege
6,137,417 A 10/2000 McDermott
6,138,995 A * 10/2000 Page ..... 261/43
6,168,645 B1 1/2001 Succi et al.
6,209,579 B1 4/2001 Bowden et al.
6,251,243 B1 6/2001 Lindsay
6,279,574 B1 8/2001 Richardson et al.
6,312,589 B1 11/2001 Jarocki et al.
6,374,845 B1 4/2002 Melendez et al.
RE37,745 E 6/2002 Brandt et al.
6,419,454 B1 7/2002 Christiansen
6,474,325 B2 11/2002 Rice et al.
6,496,752 B2 12/2002 Sudolcan et al.
6,519,938 B1 2/2003 Foss
6,557,369 B1 5/2003 Phelps et al.
6,557,459 B1 5/2003 Phelps et al.
6,607,100 B2 * 8/2003 Phelps et al. ..... 222/152
6,607,105 B2 8/2003 Phelps et al.
6,658,859 B2 12/2003 Phelps et al.
6,668,240 B2 12/2003 Singh et al.
6,669,051 B1 12/2003 Phallen et al.
6,685,054 B2 2/2004 Kameyama
6,712,342 B2 3/2004 Bosko
6,799,950 B2 10/2004 Meier et al.
6,834,534 B2 12/2004 Halla et al.
6,856,251 B1 2/2005 Tietsworth et al.
6,857,443 B2 2/2005 Volgyesi
6,925,852 B2 8/2005 Susko
6,992,590 B1 1/2006 Tietsworth et al.
7,013,908 B2 3/2006 Jones et al.
7,040,359 B2 * 5/2006 Younkle ..... 141/255
7,051,576 B2 5/2006 Hutchinson et al.
7,084,778 B2 8/2006 Shoub
7,185,528 B2 3/2007 Bristol
7,288,276 B2 10/2007 Rona et al.
7,294,839 B2 11/2007 Rich et al.
7,311,224 B2 * 12/2007 Emmendoerfer et al. .... 222/129
7,340,966 B2 3/2008 DiMatteo et al.
7,356,381 B2 4/2008 Crisp, III
7,387,123 B2 6/2008 De Silva et al.
7,449,685 B2 11/2008 Takada et al.
7,481,237 B2 1/2009 Jones et al.
2001/0032036 A1 10/2001 Sudolcan et al.
2003/0213814 A1 11/2003 Phelps et al.
2006/0208913 A1 9/2006 Christoffersen et al.
2007/0193653 A1 8/2007 Gagliano et al.
2007/0204930 A1 9/2007 Phallen et al.

* cited by examiner

BEVERAGE DISPENSING GAS CONSUMPTION DETECTION WITH ALARM AND BACKUP OPERATION

BACKGROUND

The present invention relates generally to the field of beverage dispensing gas pressure systems and in particular to a system and method for detecting a gas leak, actuating an alarm, and activating a backup gas system to continue beverage dispensing operation.

Beverages, such as beer and increasingly, wine, are driven from kegs or other containers to be dispensed from a tap by pressurized gas. Most bars and restaurants maintain at least one large tank of carbon dioxide ($CO_2$), which is necessary to provide carbonated water for a soda machine. Consequently, $CO_2$ gas is often used to pressurize the beer kegs. Pressurizing beer kegs with $CO_2$ injects excessive $CO_2$ gas into the beer, causing excessive foaminess. This effect increases as the volume of $CO_2$ relative to the volume of beer in the keg increases—that is, as the keg empties. In most cases, a bartender will swap out a keg when it is depleted to about 10% of its original volume, rather than waste time at the tap attempting to draw a beer without excessive foam.

Nitrogen gas ($N_2$) is easily filtered from atmospheric air by a N2 generator, and may be stored in a pressurized tank for use in driving beverages to a tap, either alone or in combination with $CO_2$ gas. $N_2$ is an inert gas that contains no oxygen component. Pure $N_2$ is preferred for driving wine, as it disallows oxidation of the wine and inhibits the growth of bacteria.

When beer is driven from kegs to a tap using pure $N_2$, the beer retains only the $CO_2$ resulting from its fermentation process, and is perceived as flat. The beer will contain bubbles, but may not generate a head when poured from the tap. Ideally, beer should be driven by a blend of $CO_2$ and $N_2$ gas to enhance its carbonation, but not pure $CO_2$. Further, the ideal proportion of gases varies by beer.

A known beverage dispensing system includes a $N_2$ generator that generates $N_2$ from atmospheric air as a background activity, and stores the $N_2$ gas in a pressurized container where it is available to drive beverages to taps. The system also connects to one or more conventional $CO_2$ tanks. The system mixes $N_2$ and $CO_2$ gasses in optimal ratios for distribution to beer kegs. For example, most beer requires a 60/40 ratio of $CO_2$ to $N_2$; Guniess® beer requires a ratio of 25/75. The system may dispense pure $N_2$ to drive wine.

Given the large margins in beer sales, eliminating a waste of approximately 10% per keg quickly pays for the lease or purchase of such a system, and thereafter delivers pure profit to the bar or restaurant. Bars and restaurants may purchase blended-gas beverage dispensing systems, or may lease them from a leasing company. In either case, if the system is installed and operated properly, the bar or restaurant, or the leasing company, will realize a normal operating life of the system. If there are fitting or hose leaks in the any portion of the beer dispensing operation, or if a bartender leaves the tap of an empty keg in the open position, the $N_2$ generator may run for excessive hours. This increases the cost of operation through wasted energy costs, and shortens useful life of the system. This results in increased installed cost for the system, borne by the bar or restaurant, or the leasing company, which is responsible for maintaining the system.

Additionally, in the case of leased system, the monthly leasing fee is often determined by the hours of operation of the $N_2$ generator. This practice correlates the lease fees to the actual amount of beer dispensed by the bar or restaurant. In this case, the detection of excess $N_2$ consumption may directly lower the cost of leasing the system.

SUMMARY

A mixed-gas beverage dispensing system for driving beverages from a container to a tap with a predetermined ratio of carbon dioxide ($CO_2$) and nitrogen ($N_2$) gas includes one or more monitors to detect excessive consumption of $N_2$. The system may include a $N_2$ generator, with a monitor monitoring the $N_2$ generator to detect excessive operation thereof. The system may include a $N_2$ reservoir, with a monitor monitoring the pressure in the $N_2$ reservoir. The system may include a volumetric gas flow meter interposed in one or more mixed-gas distribution lines to monitor the flow of mixed gas. Upon detecting consumption of $N_2$ gas in excess of a predetermined threshold, a monitor may trigger an audible, visual, or electronic alarm; may shut down operation of the system; and/or may switch to one or more backup gas tanks containing $CO_2$, $N_2$ or a predetermined blend thereof, for continued beverage dispensing operation.

In one embodiment, the present invention relates to a blended-gas beverage dispensing system. The system includes a nitrogen ($N_2$) gas source and a carbon dioxide ($CO_2$) gas source. The system additionally includes a controller operative to blend and dispense at least one predetermined mixture of $N_2$ and $CO_2$ gases to one or more beverage containers. The system further includes a monitor operative to detect excessive consumption of $N_2$ by the system. The system optionally also includes one or more backup gas sources, each supplying $N_2$, $CO_2$, or a predetermined blend thereof.

In another embodiment, the present invention relates to a method of dispensing beverages. $N_2$ and $CO_2$ gases are mixed in a predetermined ratio to produce a beverage dispensing gas mixture. The beverage dispensing gas mixture is distributed to at least one beverage container. The distribution is monitored to detect excessive consumption of $N_2$. Beverage dispensing gas may be distributed from at least one backup source to at least one beverage container in response to detecting excessive consumption of $N_2$.

In yet another embodiment, the present invention relates to a blended-gas beverage dispensing system. The system includes a $N_2$ gas source, a $CO_2$ gas source, and a gas blender operative to blend and dispense at least one predetermined mixture of $N_2$ and $CO_2$ gases to one or more beverage containers. The system further includes monitoring means for detecting excessive consumption of $N_2$ by the system, and may include alarm means for alerting a user to the excessive consumption of $N_2$ by the system.

DETAILED DESCRIPTION

Figure 1:
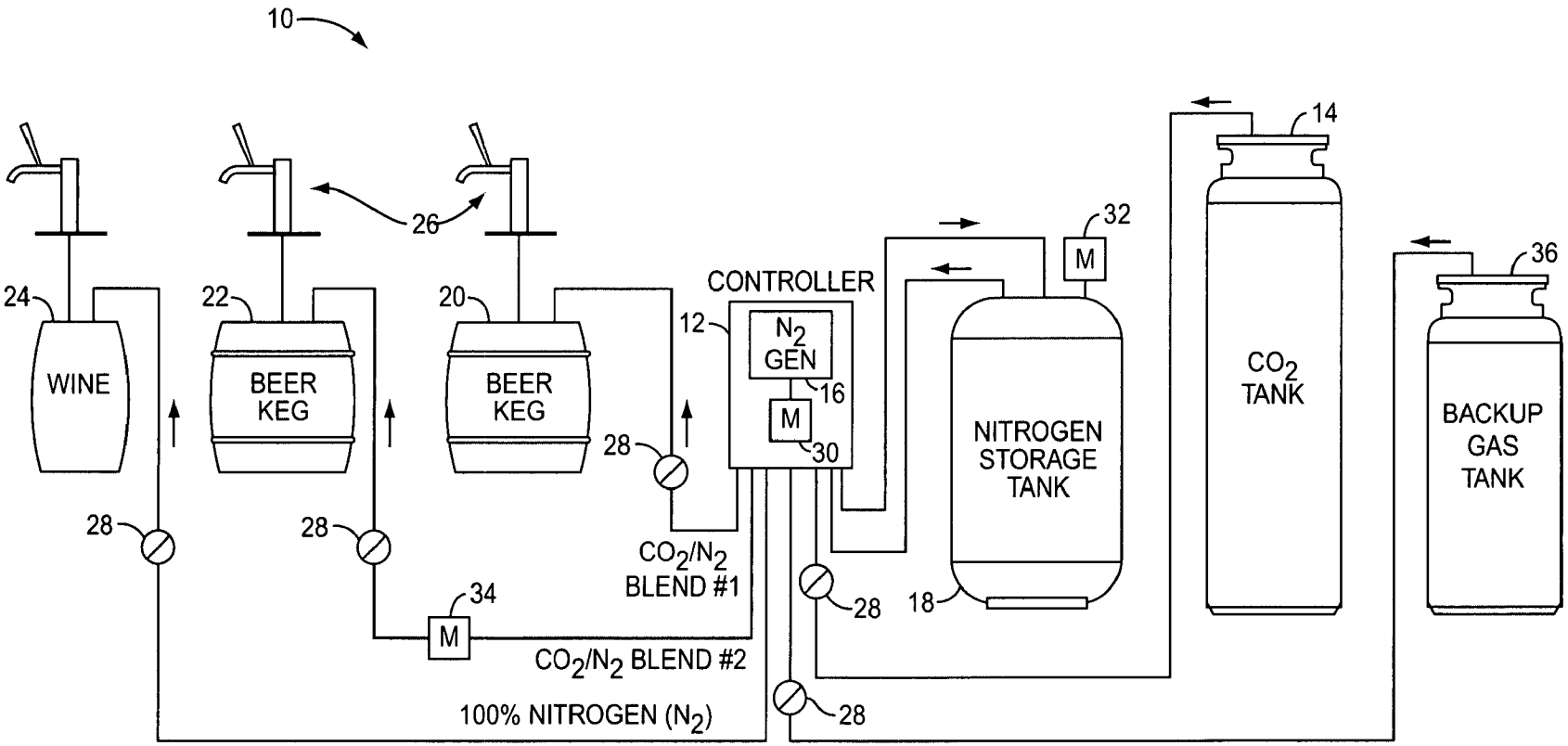
FIG. 1 is a functional block diagram of a mixed-gas beverage dispensing system.

FIG. 1 depicts a mixed-gas beverage dispensing system according to one or more embodiments of the present invention, indicated generally at 10. The system 10 includes a controller 12, to which is attached a carbon dioxide ($CO_2$) tank 14. The mixed-gas beverage dispensing system 10 additionally preferably includes a nitrogen ($N_2$) generator 16. The $N_2$ generator 16 may be housed within the controller 12, as depicted in FIG. 1, or may be located separately, but under the control of the controller 12. In some embodiments, $N_2$ gas may be provided, like the $CO_2$, in a tank; however, the $N_2$ generator 16 is preferred, as it generates $N_2$ gas more economically, and without the need to "swap out" $N_2$ tanks. Both sources of $N_2$ gas are within the scope of the present invention.

Nitrogen is a colorless, odorless, tasteless, non-toxic, non-flammable, inert, diatomic gas. Approximately 78% of atmospheric air is $N_2$ gas. Nitrogen may be extracted from atmospheric air by membrane separation, a technology that uses hollow-fiber polymer membranes to separate gaseous $N_2$ from atmospheric air by selective permeability. A membrane separation $N_2$ generator 16 may extract high purity (99.99%+) $N_2$ gas from the air economically. However, small membrane separation $N_2$ generators 16 typically do not produce a sufficient volumetric flow of $N_2$ gas to directly drive a beverage dispensing system 10. Thus, $N_2$ gas may be stored in a reservoir, such as a pressurized $N_2$ tank 18, from which high flow rates of $N_2$ gas may be extracted as necessary.

The controller 12 mixes $N_2$ gas from the $N_2$ tank 18 and $CO_2$ gas from the $CO_2$ tank 14 in at least one predetermined ratio for distribution to a beer keg 20. $N_2$ and $CO_2$ gasses may be mixed in a separate predetermined ratio for distribution to one or more other beer kegs 22. In general, a wide variety of gas mixtures may be generated and distributed by the controller 12. In one or more embodiments, the controller 12 may additionally dispense pure $N_2$ gas to one or more wine containers 24. In all cases, the gasses entering the beverage containers displace the beverage to a tap 26, as well known in the art. Shut-off valves 28 allow system components to be changed as necessary, without pressure loss or waste of gases.

Excessive consumption of $N_2$ gas may result from improper fittings or punctures in one or more gas distribution lines. Alternatively, or additionally, improper operation may cause excessive $N_2$ consumption. For example, if a bartender leaves a tap 26 connected to an empty keg 20, 22, 24 in the open position, the combined $CO_2/N_2$ gas will flow freely, escaping into the air. According to one or more embodiments of the present invention, the mixed-gas beverage distribution system 10 includes one or more monitors to detect excessive $N_2$ consumption, and in one embodiment includes a backup gas tank 36 to allow for continued operation following the detection of excessive $N_2$ consumption during normal operation.

In one embodiment, the operation of the $N_2$ generator 16 is monitored by a monitor 30. An anticipated level of $N_2$ generator 16 operation may be programmed into the monitor 30. Operation of the $N_2$ generation 16 beyond this level may cause the monitor 30 to trigger an alarm, or to shut down the beverage dispensing system 10. The monitor 30 may meter the flow of electricity to the $N_2$ generator 16, triggering an alarm, shutting down the system 10, or switching to a backup gas tank 36, when the $N_2$ generator 16 consumes in excess of a predetermined amount of power. Alternatively, the monitor 30 may monitor the "on" or active duration of the $N_2$ generator 16, comparing the operating time to a predetermined value.

In another embodiment, a monitor 32 attached to the $N_2$ storage tank 18 may monitor the pressure of reserve $N_2$ gas in the tank 18. If a leak or other condition persists, the $N_2$ pressure may drop below a predetermined threshold, at which point the monitor 32 may trigger an alarm, shut down the system 10, or switch to the backup gas tank 36 for continued operation while the cause of the depleted $N_2$ gas pressure is found and repaired.

In another embodiment, one or more monitors 34 may be interposed in one or more gas dispensing lines, to measure the volumetric flow rate of gas through the line. If a greater than expected volume of gas flows through the line within a predetermined time period, the monitor 34 may trigger an alarm, shut down the system 10, or switch to the backup gas tank 36 for continued operation while the cause of the elevated volumetric gas flow is found and repaired.

If one or more monitors 30, 32, 34 detect an excessive, or greater than anticipated, consumption of $N_2$ gas, the respective monitor 30, 32, 34 may trigger an alarm. The alarm may be audible, such as a bell, buzzer, or the like. Alternatively, or additionally, the monitor 30, 32, 34 may trigger a visual indicator, such as illuminating a steady or flashing light, displaying a warning message on a display panel, or the like. In one embodiment, the monitor 30, 32, 34, upon detection of excessive $N_2$ consumption, may output a wired or wireless electronic signal to a data processing system such as a PC, a point of sale (POS) terminal system, or the like. In one embodiment, the monitor 30, 32, 34 may initiate a wireless page or cellular call to a leasing company and/or a service technician.

In one embodiment, the gas beverage dispensing system 10 includes a backup gas tank 36. Upon sensing abnormal operation by a monitor 30, 32, 34, the controller 12 may switch operation from the $CO_2$, $N_2$ and/or blended $CO_2/N_2$ sources, and drive all beverage kegs from the backup gas tank 36. The backup gas tank 36 may contain pure $CO_2$ gas, pure $N_2$ gas, or a predetermined blend of $CO_2$ and $N_2$. During backup gas tank 36 operation, not all beverage kegs 20, 22, 24 will be driven by the optimal gas mixture (determined by the beverage being dispensed). However, the backup gas tank 36 allows for continued operation of the gas beverage dispensing system 10, while troubleshooting and repair proceed on the system 10 normal gas blending and dispensing portions. In this manner, the bar or restaurant does not experience any "down time" in beverage dispensing operations. In one embodiment, two or more backup gas tanks 36 store different gases and/or different blends of $CO_2$ and $N_2$. In this embodiment, optimal or near-optimal system performance may be maintained during backup operations by selectively directing gas from each backup gas tank 36 to the appropriate beverage keg 20, 22, 24.

Upon noticing an alarm from the monitor 30, 32, 34, a user or service technician may inspect the beverage dispensing system 10 for leaks or operator errors, and/or may initiate diagnostics testing. In one embodiment, the monitors 30, 32, 34 may be easily reset, for example, to the original predetermined threshold plus 10%. This may allow an operator to account for transient, unusually heavy use of the system 10 (such as for during sporting event or other occasion prompting a surge of beer sales).

Figure 2:
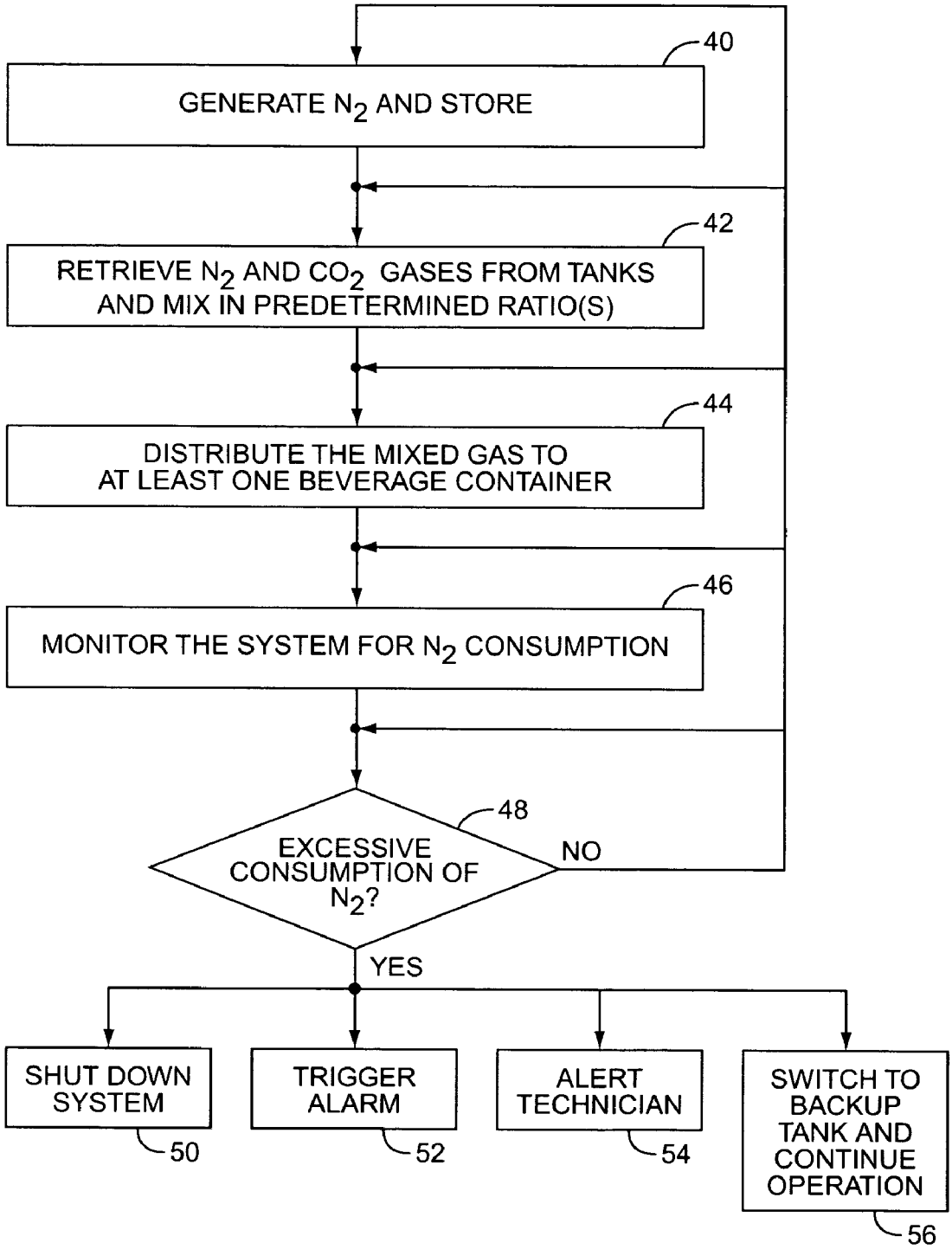
FIG. 2 is a flow diagram of a method of dispensing beverages.

FIG. 2 depicts a method of dispensing beverages without consuming excess $N_2$ gas. $N_2$ gas is optionally generated and stored in a reservoir 18 (block 40). As discussed above, in some embodiments, this step may be omitted by using replaceable $N_2$ source tanks. In either case, $N_2$ and $CO_2$ gases are retrieved from storage tanks 18, 14, as necessary, and mixed according to one or more predetermined ratios (block 42). The mixed gas is distributed to one or more beverage containers 20, 22, 24, to displace beverages to taps 26 (block 44). The system is monitored for excess $N_2$ consumption (block 46) by monitors 30, 32, 34. Note that, while FIG. 2 depicts the above steps as occurring sequentially, at least the monitoring step is performed simultaneously with all other method steps. If excess consumption of $N_2$ is detected (block 48), the monitor 30, 32, 34 may shut down the system 10 (block 50). Additionally or alternatively, monitor 30, 32, 34 may trigger an audible or visual alarm (block 52). As another option, the monitor 30, 32, 34 may alert a service technician (block 54), such as by initiating a wireless page or cellular telephone call. Finally, in addition to all other actions, the monitor 30, 32, 34 may direct the system 10 to switch to one or more backup tanks 36 and continue operation (block 56). If no excess consumption of $N_2$ is detected (block 48)—i.e., the system is operating normally and within anticipated parameters—the method steps of blocks 40-44 proceed as necessary, with the monitoring stop of block 46 proceeding in parallel.

By monitoring the generation, storage, and/or distribution of $N_2$ gas, the mixed-gas beverage distribution system 10 may alert users to excessive consumption of $N_2$ gas. In this manner, the maximum lifetime of the system 10 may be realized by avoiding wasteful operation, and in the case of leasing charges correlated to the operation of the $N_2$ generator 16, may result in direct cost savings. Furthermore, by switching operation to one or more backup gas tanks 36, beverage dispensing down time may be avoided in the event that excessive consumption of $N_2$ gas is detected.

Although the present invention has been described herein with respect to particular features, aspects and embodiments thereof, it will be apparent that numerous variations, modifications, and other embodiments are possible within the broad scope of the present invention, and accordingly, all variations, modifications and embodiments are to be regarded as being within the scope of the invention. The present embodiments are therefore to be construed in all aspects as illustrative and not restrictive and all changes coming within the meaning and equivalency range of the appended claims are intended to be embraced therein.

What is claimed is:

1. A blended-gas beverage dispensing system, comprising:

a nitrogen ($N_2$) gas source;

a carbon dioxide ($CO_2$) gas source;

a controller operative to blend and dispense at least one predetermined mixture of $N_2$ and $CO_2$ gases to one or more beverage containers; and a monitor operative to detect excessive consumption of the $N_2$ by the system.

2. The system of claim 1 further comprising one or more backup gas sources, each supplying $N_2$, $CO_2$, or a predetermined blend thereof.

3. The system of claim 2 wherein, in response to the monitor, the controller is further operative to dispense gas from a backup gas source to one or more beverage containers.

4. The system of claim 1 wherein the $N_2$ source is a $N_2$ generator operative to extract $N_2$ gas from atmospheric air.

5. The system of claim 4 wherein the monitor is operative to detect excessive operation of the $N_2$ generator.

6. The system of claim 5 wherein the monitor monitors the power consumed by the $N_2$ generator.

7. The system of claim 5 wherein the monitor monitors the duration of operation of the $N_2$ generator.

8. The system of claim 4 further comprising a $N_2$ gas storage reservoir.

9. The system of claim 8 wherein the monitor is operative to detect a decrease in pressure in the $N_2$ gas storage reservoir below a predetermined threshold.

10. The system of claim 1 wherein the monitor monitors a volumetric flow of gas in one or more gas flow lines connecting the gas blender to one or more of the beverage containers.

11. The system of claim 1 wherein the monitor is further operative to shut the system down upon detecting excessive consumption of $N_2$ in the system.

12. The system of claim 1 wherein the monitor is further operative to trigger an alarm upon detecting excessive consumption of $N_2$ in the system.

13. The system of claim 12 wherein the alarm is audible.

14. The system of claim 12 wherein the alarm is visible.

15. The system of claim 12 wherein the alarm is an electronic signal communicated to a data processing system.

16. The system of claim 12 where the alarm activates a wireless communication to a service technician.

17. A method of dispensing beverages, comprising:

mixing nitrogen ($N_2$) and carbon dioxide ($CO_2$) gases in a predetermined ratio to produce a beverage dispensing gas mixture;

distributing the beverage dispensing gas mixture to at least one beverage container; and monitoring the distributing to detect excessive consumption of $N_2$.

18. The method of claim 17 further comprising terminating the distribution in response to detecting excessive consumption of $N_2$.

19. The method of claim 17 further comprising issuing an alarm in response to detecting excessive consumption of $N_2$.

20. The method of claim 19 wherein the alarm is audible.

21. The method of claim 19 wherein the alarm is visible.

22. The method of claim 19 wherein the alarm is an electronic signal communicated to a data processing system.

23. The method of claim 17 further comprising distributing beverage dispensing gas from at least one backup source to at least one beverage container in response to detecting excessive consumption of $N_2$.

24. The method of claim 23 wherein the backup source contains $N_2$.

25. The method of claim 23 wherein the backup source contains $CO_2$.

26. The method of claim 23 wherein the backup source contains a predetermined blend of $CO_2$ and $N_2$.

27. The method of claim 17 wherein monitoring the distribution comprises monitoring the volumetric flow of mixed gas in one or more gas flow lines connected to the at least one beverage dispenser.

28. The method of claim 17 further comprising generating $N_2$ from atmospheric air by an $N_2$ generator.

29. The method of claim 28 wherein monitoring the distribution comprises monitoring the operation of the $N_2$ generator.

30. The method of claim 17 wherein monitoring the operation of the $N_2$ generator comprises monitoring the power consumed by the $N_2$ generator.

31. The method of claim 17 wherein monitoring the operation of the $N_2$ generator comprises monitoring the duration of operation of the $N_2$ generator.

32. The method of claim 28 further comprising storing generated $N_2$ gas in a pressurized tank.

33. The method of claim 32 wherein monitoring the distribution comprises monitoring the pressure in the $N_2$ tank.

34. A blended-gas beverage dispensing system, comprising:

a nitrogen ($N_2$) gas source;

a carbon dioxide ($CO_2$) gas source;

a gas blender operative to blend and dispense at least one predetermined mixture of $N_2$ and $CO_2$ gases to one or more beverage containers; and monitoring means for detecting excessive consumption of the $N_2$ by the system.

35. The system of claim 34, further comprising one or more backup gas sources, and wherein the blended-gas beverage dispensing system is operative to dispense gas from the a backup gas source to one or more beverage containers in response to detecting excessive consumption of $N_2$ by the system.

36. The system of claim 30, further comprising alarm means for alerting a user to the excessive consumption of $N_2$ by the system.

* * * * *